US010746027B2

(12) United States Patent
Buchal

(10) Patent No.: US 10,746,027 B2
(45) Date of Patent: Aug. 18, 2020

(54) BLADE AIRFOIL FOR AN INTERNALLY COOLED TURBINE ROTOR BLADE, AND METHOD FOR PRODUCING THE SAME

(71) Applicant: Siemens Aktiengesellschaft, Munich (DE)

(72) Inventor: Tobias Buchal, Düsseldorf (DE)

(73) Assignee: Siemens Aktiengesellschaft, Munich (DE)

( * ) Notice: Subject to any disclaimer, the term of this patent is extended or adjusted under 35 U.S.C. 154(b) by 29 days.

(21) Appl. No.: 16/145,792

(22) Filed: Sep. 28, 2018

(65) Prior Publication Data

US 2019/0120066 A1 Apr. 25, 2019

(30) Foreign Application Priority Data

Oct. 19, 2017 (EP) ..... 17197244

(51) Int. Cl.
*F01D 5/18* (2006.01)
*F01D 9/04* (2006.01)
(Continued)

(52) U.S. Cl.
CPC ..... *F01D 5/186* (2013.01); *F01D 5/20* (2013.01); *F01D 9/041* (2013.01); *F01D 11/10* (2013.01);
(Continued)

(58) Field of Classification Search
CPC . F01D 5/18; F01D 5/186; F01D 5/187; F01D 5/20; F01D 9/041; F01D 11/10;
(Continued)

(56) References Cited

U.S. PATENT DOCUMENTS 5,100,293 A * 3/1992 Anzai ..... F01D 5/186 416/96 A
6,224,336 B1 * 5/2001 Kercher ..... F01D 5/186 415/115

(Continued)

FOREIGN PATENT DOCUMENTS

EP 0965728 A2 12/1999
EP 1793087 A1 6/2007

OTHER PUBLICATIONS

EP search report dated Jan. 25, 2018, for corresponding EP patent application No. 17197244.1.

*Primary Examiner* — Richard A Edgar
(74) *Attorney, Agent, or Firm* — Beusse Wolter Sanks & Maire

(57) ABSTRACT

A blade airfoil for an internally cooled turbine rotor blade has suction-side and pressure-side side walls, which, extending from a common leading edge to a common trailing edge and in a span direction from a root-side end to a tip-side end, at least partially enclose a cavity. The tip-side end includes a tip wall which delimits the cavity at the tip side. At least one cooling hole for the discharge of cooling fluid that can be caused to flow in the interior is provided. In the cavity, at least one rib which extends from the tip wall in the direction of the root-side end projects from the inner surface, surrounding the rib, of the suction-side side wall and/or from the inner surface of the pressure-side side wall. An inflow-side end, in relation to the cooling fluid, of the at least one cooling hole opens out laterally in the respective rib.

14 Claims, 4 Drawing Sheets

(51) Int. Cl.

| | |
|---|---|
| ***F01D 25/12*** | (2006.01) |
| ***F01D 5/20*** | (2006.01) |
| ***F01D 11/10*** | (2006.01) |
| ***F01D 25/32*** | (2006.01) |
| *F01D 11/08* | (2006.01) |

(52) U.S. Cl.
CPC ..... *F01D 25/12* (2013.01); *F01D 25/32* (2013.01); *F01D 11/08* (2013.01); *F05D 2220/32* (2013.01); *F05D 2230/13* (2013.01); *F05D 2240/12* (2013.01); *F05D 2240/24* (2013.01); *F05D 2260/202* (2013.01)

(58) Field of Classification Search
CPC ..... F01D 11/08; F01D 25/12; F05D 2220/32; F05D 2230/13; F05D 2240/12; F05D 2240/24; F05D 2260/202
USPC ..... 416/126
See application file for complete search history.

(56) References Cited

U.S. PATENT DOCUMENTS

| | | | | |
|---|---|---|---|---|
| 7,293,962 | B2 * | 11/2007 | Fried | F01D 5/187 415/115 |
| 9,382,811 | B2 * | 7/2016 | Harding | F01D 5/187 |
| 2012/0308392 | A1 | 12/2012 | Butkiewicz et al. | |
| 2017/0159450 | A1 | 6/2017 | Buhler et al. | |

* cited by examiner

BLADE AIRFOIL FOR AN INTERNALLY COOLED TURBINE ROTOR BLADE, AND METHOD FOR PRODUCING THE SAME

CROSS REFERENCE TO RELATED APPLICATIONS

This application claims the benefit of European Application No. EP17197244 filed 19 Oct. 2017, incorporated by reference herein in its entirety.

FIELD OF INVENTION

The invention relates to a blade airfoil for an internally cooled turbine rotor blade. The invention also relates to a method for producing a blade airfoil.

BACKGROUND OF INVENTION

Turbine blades and the blade airfoils thereof have long been known from the extensive available prior art. In order that the turbine blades can permanently withstand the high temperatures that arise during operation, they are designed to be coolable. For this purpose, they have, in the interior, a cavity which can be flowed through by a coolant, normally cooling air, during operation. After flowing through the turbine blade and in particular through the blade airfoil thereof, the cooling air, which is heated as it flows through, is discharged into the working fluid of the gas turbine and mixed therewith. If the cooling fluid is cooling air, this is extracted from the compressor associated with the gas turbine. Despite comprehensive measures for keeping the compressor air and also in particular the cooling air clean, said air may still contain dust and dirt particles which, as said air flow through the compressor and also as it flows through the turbine blade, can be deposited therein.

For this reason, modern constructions of turbine blades are inter alia also designed for preventing deposits of such dirt particles at the openings through which the cooling air that is heated during operation is to be discharged. Blockages of such cooling air outlets can have the effect that the cooling action at this location is realized only to a reduced extent, if at all. In this case, the admissible material temperatures are exceeded there, such that the material characteristics consequently change at the overheated location. This permits the formation of local corrosion phenomena and consequential damage, which in the worst case can lead to component failure.

To prevent this, it is known for example from EP 1 793 086 A2 for guide elements to be provided in the interior of the cooling air channels of turbine blades, by means of which guide elements the particles entrained in the cooling air are diverted. This reduces the inflow of the particles into the cooling air outlets.

In an alternative embodiment, known from EP 0 965 728 A2, it is also possible for specially shaped inlets for cooling air openings to be used. Here, by means of an ovalization of the inlet region of the cooling air hole, it is achieved that an entrained particle cannot pass into the hole.

It is a disadvantage that such hole inlets on the inner side of blades that are normally produced by precision casting methods can be produced not by boring but only by casting. Owing to the use of precision casting methods, the cooling air holes however then have a relatively large diameter of at least approximately 2 mm, which undesirably increases the cooling air consumption. Smaller diameters cannot be produced with sufficient accuracy.

It is furthermore known for so-called dust holes to be arranged at the blade tips of turbine rotor blades. Said holes are arranged in the tip region normally centrally between suction side and pressure side and are of relatively large diameter. There is then certainly only a very low risk of blockage, but the cooling air consumption is increased as a result of this. By contrast, if the diameter thereof is reduced, for example in order to save cooling air, there is the risk of blockage, with the stated disadvantages.

SUMMARY OF INVENTION

It is therefore an object of the invention to provide a blade airfoil for an internally cooled turbine rotor blade, the cooling holes of which exhibit a relatively low tendency to become contaminated by particles entrained in the cooling air. It is a further object of the invention to specify a method by means of which blade airfoils according to the invention can be produced easily and with greater reliability than previously.

This former object is achieved according to the invention by means of a blade airfoil, and the latter object is achieved by means of a production method as per the independent claims.

Dependent subclaims and the following description relate in each case to advantageous refinements of the device according to the invention.

The present invention proposes, in the case of a blade airfoil for an internally cooled turbine rotor blade, comprising a suction-side side wall and a pressure-side side wall, which, extending from a common leading edge to a common trailing edge and in a span direction from a root-side end to a tip-side end, at least partially enclose a cavity, wherein the tip-side end comprises a tip wall which delimits the cavity at the tip side and in which at least one cooling hole, advantageously multiple cooling holes, for the discharge of cooling fluid that can be caused to flow in the interior is or are provided, that, in the cavity, at least one rib which extends from the tip wall in the direction of the root-side end, advantageously multiple such ribs, project(s) from the inner surface, surrounding said rib, of the suction-side side wall or from the inner surface, surrounding said rib, of the pressure-side side wall, and that an inflow opening, in relation to the cooling fluid, of the at least one cooling hole opens out laterally in the respective rib.

The invention is based on the realization that the arrangement of the inflow opening of the cooling hole laterally in a rib which projects from the inner surface of the side wall significantly impedes the inflow of particles entrained in the cooling air. Owing to the impeded inflow of particles into the cooling hole, the risk of blockage decreases, which can lengthen the service life of the blade airfoil and of a turbine rotor blade equipped therewith.

The lateral arrangement of the inflow opening in the rib can advantageously be realized, in the case of cooling holes of rectilinear design, if a channel axis of the cooling hole is arranged so as to be inclined relative to the longitudinal direction of the rib between the tip-side and root-side ends. Here, it is not of importance whether the cooling hole or the rib is oriented strictly radially. Alternatively and/or in addition to the relative inclination between cooling hole and rib, the lateral arrangement can be realized if the cooling hole is of not rectilinear but curved design along its channel axis. It is then sufficient for the cooling hole, in the region of the inflow opening—that is to say immediately downstream thereof—to be inclined relative to the local longitudinal extent of the rib. Such curved cooling holes can be easily produced by erosion. Here, the orientation of the rib is of secondary relevance. In both cases, the result is a grinding and/or oblique cut forming an elliptical inflow opening.

The inflow opening particular advantageously has an elliptical shape with a relatively short axis and with a relatively long axis, wherein the relatively short axis is shorter than the diameter of the rest of the cooling hole. Such an inflow opening can be produced in the blade airfoil or in the turbine blade by erosion or by laser boring. Owing to the further reduced size of the inflow opening, particles of a very similar size to or greater than the diameter of the rest of the cooling hole do not pass into the cooling hole. The only particles that pass into the cooling hole are those which are small enough that they can be discharged again with the cooling fluid without adhering therein. This reduces the risk of a blockage of the cooling hole.

In a further particularly advantageous embodiment of the invention, the respective rib has, in a cross-sectional plane normal with respect to the span direction, a curved contour with a maximum rib height H in relation to the rest of the inner surface, wherein the inflow-side end of the respective cooling hole is arranged laterally with respect to the location of the maximum rib height. As an alternative to the first advantageous embodiment, the rib may also have a polygonal, for example triangular or tetragonal contour instead of the curved contour. In particular in conjunction with the curved rib contour, it is possible, by boring the cooling hole, to realize a contour for the inflow opening which equates to an inclined ellipse. Depending on the actual orientation of the bored cooling hole and of the radial and axial extent of the rib and on the cross-sectional contour thereof, the relatively long axis of the ellipse is arranged parallel or at an acute angle with respect to the inner surface of the respective side wall, but in the rib surface. Owing to the elliptical inlet contour of the inflow opening, it is possible, while realizing a relatively large inflow cross section, to provide a relatively narrow inlet slot, the relatively short axis of which is selected to be smaller than the diameter of particles that are typically entrained in the cooling air. The risk of a blockage can consequently be reduced.

It is furthermore advantageous if the respective rib is, from its tip-side end to its end arranged at the root side, inclined in the direction of the leading edge or in the direction of the trailing edge. Although the respective rib advantageously extends rectilinearly from its tip-side end to its root-side end, the longitudinal extent of the rib has an angle of greater than 0°, for example of 25°, relative to the span direction. Owing to the inclined or oblique arrangement, it is possible in particular to alleviate the problem of the exact axial positioning of the cooling hole, which is to be bored, relative to the rib. If an axial offset of the rib arises owing to production-induced casting tolerances, then the length, measured spanwise, of the bored cooling hole is duly lengthened or shortened. By contrast, however, the inlet geometry thereof, that is to say the elliptical form and also the lateral position of the inflow opening, is maintained, which furthermore keeps the tendency for the cooling hole to become blocked low. Consequently, with the stated feature, despite production-induced tolerances of the cast blade airfoil, it is possible to specify a greater range in which the cooling hole can be bored such that it still opens out laterally in the rib.

It is furthermore advantageous if the cavity adjacent to the respective rib is such that the major supply of coolant to said cavity is arranged on that side of the respective rib which is averted from that surface of the rib which has the inflow-side end of the cooling hole. In other words: the respective partial cavity of the blade airfoil in which the respective rib is arranged is fed with coolant at a particular position. The respective rib is situated downstream of this particular position of the coolant supply, wherein the inflow-side end of the cooling hole is arranged on that side of the rib which is situated opposite the incoming cooling air flow; the inflow opening is arranged in the lee of the respective rib. In conjunction with the fact that the inflow-side end of the respective cooling hole is arranged downstream of the maximum elevation of the rib, the inflow-side end is situated in the wind shadow. Particles entrained in the coolant thus flow along the inner surface of the respective side wall to the rib, are lifted by the latter and then, owing to their inertia, inevitably flow across the inflow opening of the cooling hole without being able to enter said inflow opening. This embodiment significantly reduces the likelihood of the blockage of cooling holes.

In one particularly advantageous embodiment, at least one sealing tip is arranged on the outwardly pointing surface of the tip wall, wherein it is furthermore advantageous for the respective cooling hole to extend through at least part, advantageously the entirety, of said sealing tip.

With this embodiment, it is possible to provide sealing tips which, despite their relatively small wall thickness, can be cooled internally. The wall thicknesses of such sealing tips may have a magnitude of approximately 2 mm, wherein the cooling holes may have a diameter of 1.0 mm and smaller.

Altogether, the following aims are achieved by means of the invention:

Through the formation of obliquely, axially and/or radially tapering ribs on the lateral inner walls of the blade airfoils and by means of the simpler positioning of the cooling holes for the cooling of the tip region of the blade airfoil in the latter, it can be achieved that the inflow opening of the cooling holes forms, on the inner side, an ellipse which is inclined both radially and axially. By manufacturing the cooling hole by means of laser boring or erosion, it is furthermore possible for the projected diameter of the cooling hole to be kept smaller in the inflow region than downstream thereof or in the outflow region. In this way, the length of the relatively short axis of the ellipse can be reduced in relation to the diameter of a circular cooling hole. By means of the arrangement of a rib extending predominantly in an axial direction on the inner side of the blade wall radially with a cooling hole, it can be achieved that, for radially moving particles driven dominantly by the centrifugal force, a "ski jump" is likewise provided which allows said particles to jump over the inflow opening but not into the latter.

It is self-evident that the pairs of rib and cooling hole according to the invention may be implemented on both side walls of the blade airfoil. It is likewise self-evident to produce such blade airfoils or turbine blades by means of additive processes, for example selective laser melting or the like.

Even where certain expressions are used in each case in the singular or in conjunction with a numeral in the description and/or in the patent claims, it is not the intention for the scope of the invention to be restricted, for said expressions, to the singular or to the respective numeral. Furthermore, the words "a" or "an" are to be understood not as numerals but as indefinite articles.

The characteristics, features and advantages of the invention described above, and the manner in which these are achieved, will be discussed in more detail in a comprehensible manner in conjunction with the following description of the exemplary embodiments on the basis of the following figures.

BRIEF DESCRIPTION OF THE DRAWINGS

Here, the figures are illustrated merely schematically, and thus in particular do not give rise to any restriction of the practicability of the invention.

In the figures.

DETAILED DESCRIPTION OF INVENTION

Below, identical technical features are denoted by the same reference designations in all of the figures. Furthermore, features of different exemplary embodiments may be combined with one another in any desired manner.

Figure 1:
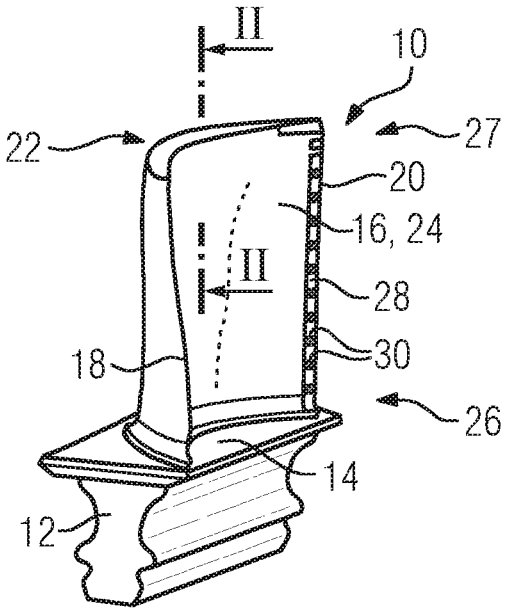
FIG. 1 shows a turbine rotor blade in a perspective schematic illustration.

FIG. 1 shows a turbine blade 10 in a perspective illustration. The turbine blade 10 is, as per FIG. 1, designed as a rotor blade. It comprises a fir-tree-shaped blade root 12 and a platform 14 arranged thereon. The platform 14 is then adjoined by a blade airfoil 16, which is aerodynamically curved. It is not of importance for the invention whether or not the blade airfoil 16 is covered by a thermal protective layer. The blade airfoil 16 comprises a suction side wall 22 and a pressure side wall 24. In relation to a hot gas flowing around the blade airfoil 16, said walls extend from a leading edge 18 to a trailing edge 20. Along the trailing edge 20 there are provided a multiplicity of openings 28 for the discharge of coolant, which openings are separated from one another by interposed webs 30. The blade airfoil 16 extends along a span direction, which coincides with a radial direction of a turbine, from a root-side end 26 to a tip-side end 27. The latter is also known as blade tip. When the turbine blade 10 shown is used in a gas turbine through which flow passes axially, the span direction coincides with the radial direction R of the gas turbine.

Figure 2:
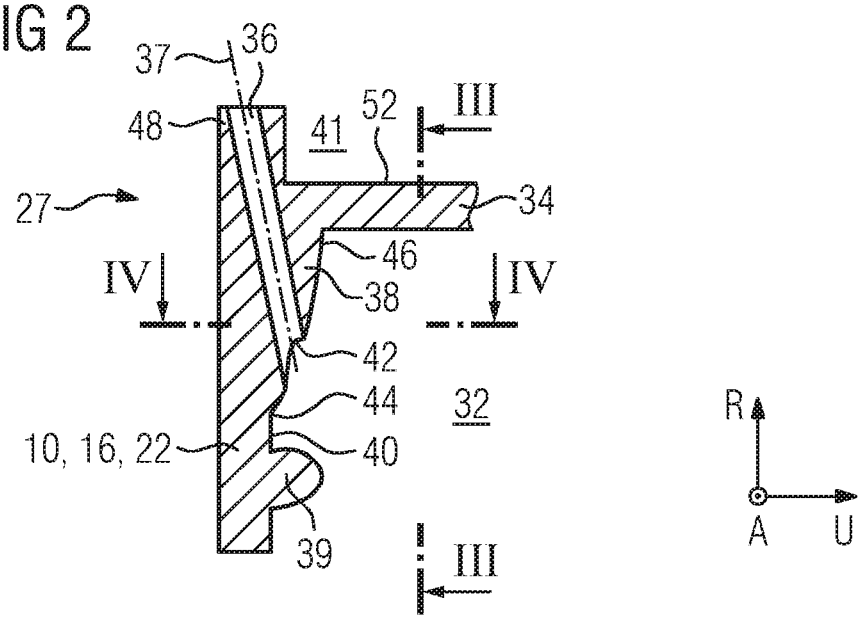
FIG. 2 shows the longitudinal section through the blade airfoil of the turbine rotor blade as per FIG. 1 as a first exemplary embodiment.

FIG. 2 shows a sectional illustration through the blade airfoil 16 as per the section line II-II as a first exemplary embodiment of a blade airfoil 16 according to the invention. FIG. 2 illustrates only the radially outer end of the blade airfoil 16 in relation to the span or radial direction R of the gas turbine, that is to say the blade airfoil tip. Installed in a gas turbine, the blade airfoil 1 extends in the radial direction R. Further axes of the gas turbine are denoted by A and U, wherein A stands for axial direction and U represents the circumferential direction. Below, these will be used where required for the purposes of more easily describing the arrangement.

The blade airfoil 16 has, on the tip-side end 27, a tip wall 34 which delimits a cavity 32 to the outside. The tip wall 34 is substantially at right angles to the suction-side side wall 22 and transitions into the latter. In the transition region, a rib 38 is arranged on an inner surface 40, pointing toward the cavity 32, of the suction-side side wall 22. The rib 38 extends rectilinearly from its end 46 arranged at the tip side to its end 44 arranged at the root side.

A further rib 39, which runs in an axial direction, is provided so as to be adjacent to and spaced apart from the rib 38 in a radially inward direction, in order to divert particles in the case of a possible radially occurring cooling flow.

On the radially outwardly pointing surface 52 of the tip wall 34, there is also arranged a sealing tip 48, which is part of said tip wall. Such sealing tips, also referred to in English as "squealer tips", are normally realized as radial elongations of the side walls 22, 24 of the turbine rotor blade 10. They serve for reducing a gap between the blade tip and the hot-gas path delimitation, situated opposite said blade tip, of the gas turbine. The sealing tips 48 may be arranged without a step in relation to the outer side surfaces of the suction-side side wall 22 or pressure-side side wall 24, as shown.

In the exemplary embodiment illustrated in FIG. 2, a cooling hole 36 extends through the tip wall 34 together with sealing tip 48 into the rib 38. The cooling hole 36 has an inflow opening 42 for a cooling fluid. A cooling fluid that can be supplied to the cavity 32 can flow into said opening 42, flow along the cooling hole 36, and emerge at the outer end. During this time, the cooling fluid cools the local region of the suction-side side wall 22, of the tip wall 34 and in particular the sealing tip 48. It is self-evident that several of the pairs of cooling holes 36 and ribs 38 as shown and described in more detail further below may be provided at the blade tip of a turbine blade 10. This is the case in particular if the sealing tip 48 extends along the entire boundary of the blade airfoil 16.

The cooling hole 36 need not imperatively extend through the sealing tip 48. In an alternative embodiment, the cooling hole 36 may also end laterally with respect to the sealing tip 48. It may for example end on the hot gas side or in the tip clearance 39.

Figure 3:
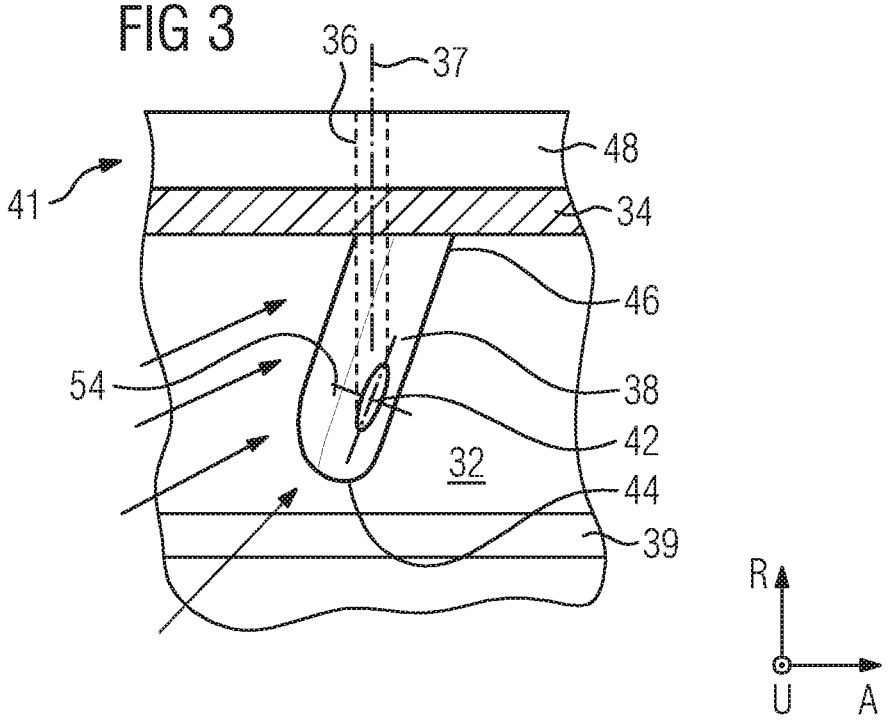
FIG. 3 shows the side view of an inner surface of a side wall of the blade airfoil as per the view III-III.
Figure 5:
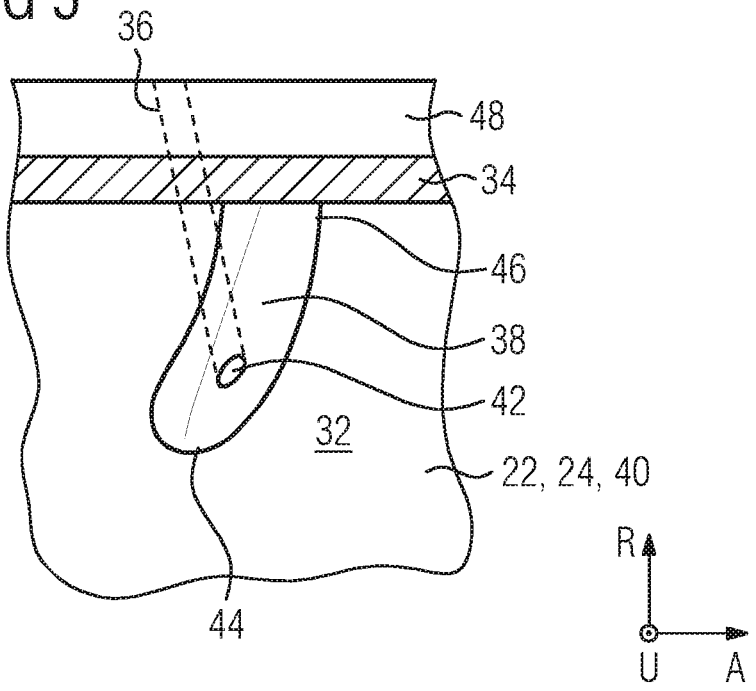
FIG. 5 shows an alternative exemplary embodiment of a rib-cooling hole pairing according to the invention in a side view.

FIG. 3 shows the plan view of the interior of the blade tip as per the section line III-III from FIG. 2. On the basis of the reference to the different directions in the installed blade airfoil 16 in a gas turbine, it can be seen that the rib 38 is designed to be inclined relative to the radial direction. The rib 38 as per the exemplary embodiment shown here extends rectilinearly from its tip-side end 46 to its root-side end 44. At the same time, the cooling hole 36, which extends through the sealing tip 48 and the tip wall 34 into the rib 38 is oriented parallel to the radial direction R, but here is inclined in the circumferential direction (FIG. 2). The depicted orientations of the cooling hole 36 and of the rib 37 are not imperatively necessary, but rather are in each case dependent on the orientation of the aerodynamically curved blade airfoil in space, on the one hand, and the location of the cooling hole, on the other hand. Advantageously, a channel axis 37 of the cooling hole 36 in the region of the inflow opening 42 is inclined at an obtuse angle relative to the longitudinal extent of the rib 38. To achieve this, it is for example possible for the cooling hole 36, and likewise the rib 38, to be inclined in the circumferential direction U and/or in the axial direction A. A cooling hole 36 inclined in the axial direction is illustrated as a second exemplary embodiment in FIG. 5, and opens out in the rib 38, which is designed to be curved in the radial direction. Furthermore, FIG. 5 shows, in addition to the features already described, an elliptical inflow opening 42, the relatively short axis 54 of which is shorter than the diameter of the rest of the cooling hole 36, which is of circular cross section.

Figure 4:
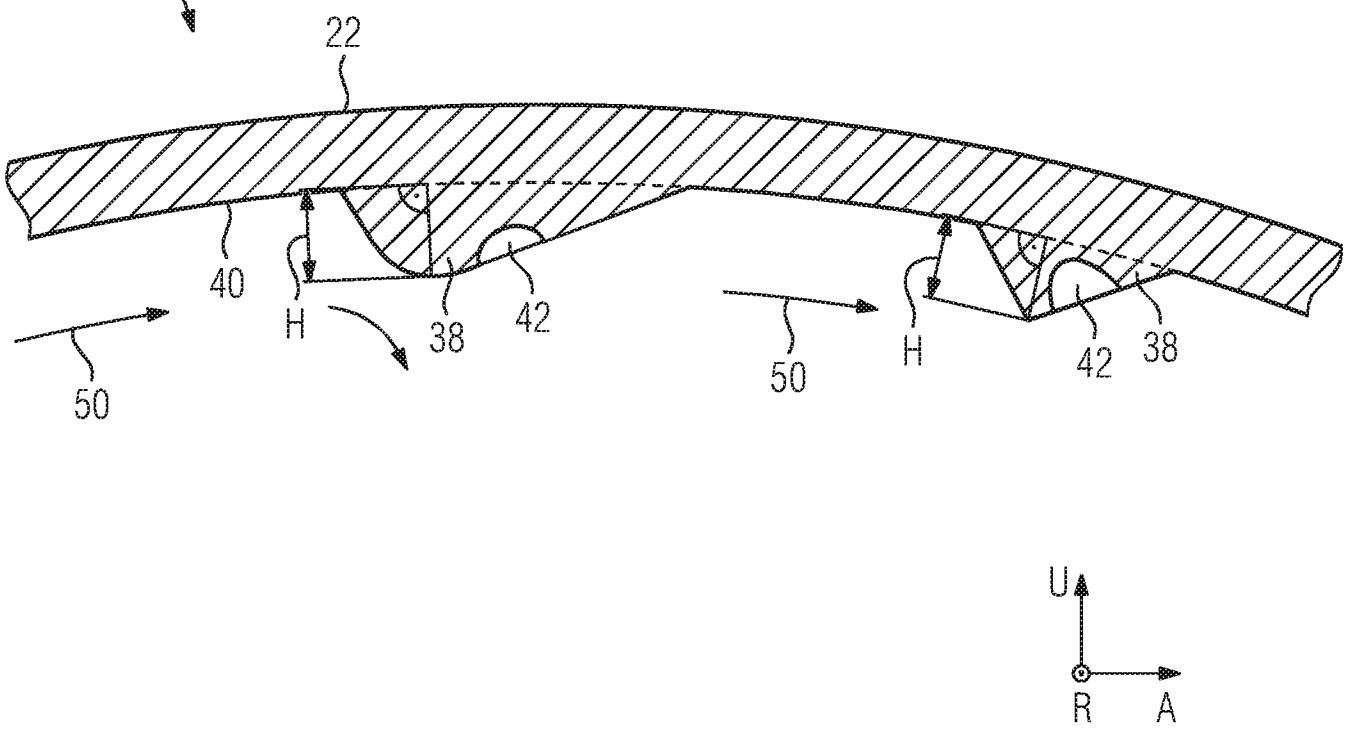
FIG. 4 shows the cross section as per the section line IV-IV through the blade airfoil as per FIG. 2.

FIG. 4 shows the section through the blade-tip-side end 27 of the blade airfoil 16 as per the section line IV-IV from FIG.

2. In the exemplary embodiment shown, on the suction side, two ribs 38 according to the invention are provided, of which the first projects in asymmetrically curved form from the inner surface 40 of the suction-side side wall 22. By contrast, the second of the two ribs 38 according to the invention is of triangular shape in this cross-sectional view, which cross-sectional plane lies normally with respect to the radial direction R. It is not necessary for the rib to protrude from the inner surface in the manner of turbulators or the like; the transition from inner surface 40 to the side surface of the rib 38 may also, in particular on the incident-flow side thereof, be of stepless form and thus exhibit low aerodynamic losses.

The cooling holes 36 open out in one of the side surfaces of the ribs 38. The position of the opening 42 is, according to the invention, in that side surface of the rib 38 which is arranged beyond a maximum rib height H. The rib height H is in relation to the rest of the inner surface 40 of the suction-side wall 22.

During operation, a cooling fluid, advantageously cooling air, is supplied in the interior of the blade airfoil 16 of the internally cooled turbine rotor blade 10. The cavity 32 is accordingly flowed through by the cooling fluid, and the cooling fluid has a predefined main flow direction 50 owing to the topology of the cavity 32 and the position of a cooling air supply and the position of adjoining outflow channels. Said main flow direction is to be determined in the immediate vicinity of the rib 38 according to the invention. Since the cooling fluid can never be entirely free from dirt particles, it is advantageous if the inflow opening 42 of the cooling hole 36 is arranged on that side of the respective rib 38 which is averted from the cooling fluid flowing toward the respective rib. The inflow opening 42 of the cooling hole 36 is situated, as it were, more in the wind shadow—in the lee—of the maximum rib height H. Owing to the shape of the rib 38, particles entrained by the cooling fluid are diverted into a flow path in which, with increasing distance covered, said particles move progressively further away from the inner surfaces of the side walls 22, 24, to the point of the maximum rib height H. Subsequently, owing to their inertia and the flow direction pointing away from the inflow opening 42, said particles pass by the inflow opening; said particles can flow into the cooling hole 36 only under adverse conditions. This has the result that air with fewer particles—in relation to the prior art—flows into the cooling holes 36, and thus the risk of blockage is reduced. This permits the use of cooling holes 36 with a particularly small diameter, for example even smaller than one millimeter, with a reduced risk of blockage of the inflow openings 42 or of the cooling holes 36 by entrained particles.

Owing to the curved contour of the rib 38 and of the orientations, inclined either in the circumferential direction U and/or in the axial direction A relative to the radial direction R, of the, in principle, rectilinear cooling holes 36, the inflow opening 42 of the cooling holes 36 that open out in the rib 38 is not circular but rather is inclined in elliptical fashion, with a relatively long axis and a relatively short axis. This alone would make it more difficult, in the case of cooling air flowing in alignment with the rectilinear cooling hole 36, for particles to flow into the respective cooling hole 36.

The cooling hole 36 may be produced retroactively, after the casting of the turbine blade 10, by boring. The orientation of the rib 38 inclined in relation to the radial direction R is particularly advantageous. For example in the case of a rectilinear cooling hole 36 bored in the radial direction R, the inclined rib 38 (FIG. 3) offers the advantage that the cooling hole 36 can be located in a relatively large axial section AB. As long as the cooling hole 36 is located in the section AB, it has an elliptically shaped inflow opening 42 which is always arranged in the lee on the side situated downstream of the incoming cooling fluid. This improves the producibility of a turbine blade 10 of said type, because the section AB in which the cooling hole is to be bored is relatively large, and thus easier to arrive at.

Altogether, with the invention, a blade airfoil 16 for an internally cooled turbine rotor blade 10 is provided, comprising a suction-side side wall 22 and a pressure-side side wall 24, which, extending from a common leading edge 18 to a common trailing edge 20 and in a span direction from a root-side end 26 to a tip-side end 27, at least partially enclose a cavity, wherein the tip-side end 27 comprises a tip wall 34 which delimits the cavity 32 at the tip side and in which at least one cooling hole 36, advantageously multiple cooling holes 36, for the discharge of cooling fluid that can be caused to flow in the interior is or are provided. To provide a turbine blade in the case of which the risk of blockages of cooling holes is reduced and thus the service life of the turbine blade 10 can be lengthened, it is proposed that, in the cavity 32, at least one rib which extends from the tip wall 34 in the direction of the root-side end 42, advantageously multiple such ribs 38, projects from the inner surface 40, surrounding said rib, of the suction-side side wall 22 and/or from the inner surface 40 of the pressure-side side wall 24, and that an inflow opening 42, in relation to the cooling fluid, of the at least one cooling hole 36 opens out laterally in the respective rib 38.

The invention claimed is:

1. A blade airfoil for an internally cooled turbine rotor blade, comprising:

a suction-side side wall and a pressure-side side wall, which, extending from a leading edge to a trailing edge and in a span direction from a root-side end to a tip-side end, at least partially enclose a cavity, wherein the tip-side end comprises a tip wall which delimits the cavity at the tip-side end, and at least one cooling hole adapted for discharge of cooling fluid that can be caused to flow in the interior, wherein, in the cavity, at least one rib which extends from the tip wall in a direction of the root-side end projects from an inner surface of the suction-side side wall or from an inner surface of the pressure-side side wall, wherein an inflow opening of the at least one cooling hole opens out laterally in the respective rib, wherein the at least one cooling hole comprises a channel axis which, at least in a region of the inflow opening of the at least one cooling hole, is inclined relative to a longitudinal extent of the at least one rib, wherein the respective rib is, from its tip-side end to its root side end, inclined in a direction of the leading edge or in a direction of the trailing edge, wherein the tip wall comprises at least one sealing tip on its outwardly pointing surface, and wherein the at least one cooling hole extends through the tip wall and the at least one sealing tip into the at least one rib.

2. The blade airfoil as claimed in claim 1, wherein the inflow opening comprises an elliptical shape comprising a relatively short axis and a relatively long axis, wherein the relatively short axis is shorter than a diameter of the at least one cooling hole.

3. The blade airfoil as claimed in claim 1, wherein the respective rib comprises, in a cross-sectional plane normal with respect to the span direction, a curved contour comprising a maximum rib height in relation to a rest of the inner surface, and the inflow opening of the respective cooling hole is arranged laterally with respect to a location of the maximum rib height.

4. The blade airfoil as claimed in claim 1, wherein the respective rib comprises, in a cross-sectional plane normal with respect to the span direction, a polygonal contour comprising a maximum rib height in relation to a rest of the inner surface, and the inflow opening of the respective cooling hole is arranged on a laterally arranged surface of the rib.

5. The blade airfoil as claimed in claim 1, wherein the cavity adjacent to the respective rib is such that a major supply of coolant to said cavity is arranged on that side of the respective rib which is averted from that surface of the rib which comprises the inflow opening of the at least one cooling hole.

6. A turbine rotor blade comprising:

a blade airfoil as claimed in claim 1.

7. A method for producing a blade airfoil as claimed in claim 1, the method comprising:

boring the at least one cooling hole such that the inflow opening opens out in one of the respective ribs.

8. The method of claim 7, further comprising casting the blade airfoil before boring the at least one cooling hole.

9. The method of claim 7, wherein the blade airfoil comprises multiple ribs.

10. The blade airfoil as claimed in claim 1, further comprising:

multiple cooling holes.

11. The blade airfoil as claimed in claim 1, further comprising:

multiple ribs.

12. The blade airfoil as claimed in claim 1, wherein the respective cooling hole extends through an entirety of the sealing tip.

13. A blade airfoil for an internally cooled turbine rotor blade, comprising:

a suction-side side wall and a pressure-side side wall, which, extending from a leading edge to a trailing edge and in a span direction from a root-side end to a tip-side end, at least partially enclose a cavity, wherein the tip-side end comprises a tip wall which delimits the cavity at the tip-side end and which comprises sealing tip on an outwardly pointing surface of the tip wall, and a cooling hole adapted for discharge of cooling fluid that can be caused to flow in the interior, wherein, in the cavity, a rib extends from the tip wall in a direction of the root-side end farther than the rib projects from an inner surface of the suction-side side wall or from an inner surface of the pressure-side side wall, wherein an inflow opening of the cooling hole opens out laterally in the rib, and wherein the cooling hole extends through the tip wall and extends through the sealing tip into the rib.

14. The blade airfoil as claimed in claim 13, wherein the cooling hole extends through an uppermost surface of the sealing tip.

* * * * *